US009587605B2

(12) United States Patent
Wundling et al.

(10) Patent No.: US 9,587,605 B2
(45) Date of Patent: Mar. 7, 2017

(54) HOLDING FIXTURE FOR AN INJECTION DEVICE FOR INJECTING A MEDIUM INTO A COMBUSTION CHAMBER OF AN INTERNAL COMBUSTION ENGINE

(71) Applicant: Robert Bosch GmbH, Stuttgart (DE)

(72) Inventors: Claus Wundling, Freiberg (DE); Andreas Kufferath, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 14 days.

(21) Appl. No.: 14/414,275

(22) PCT Filed: May 27, 2013

(86) PCT No.: PCT/EP2013/060852
§ 371 (c)(1),
(2) Date: Jan. 12, 2015

(87) PCT Pub. No.: WO2014/009049
PCT Pub. Date: Jan. 16, 2014

(65) Prior Publication Data

US 2015/0192096 A1 Jul. 9, 2015

(30) Foreign Application Priority Data

Jul. 10, 2012 (DE) ..... 10 2012 212 039

(51) Int. Cl.
*F02M 53/04* (2006.01)
*F02M 61/14* (2006.01)
(Continued)

(52) U.S. Cl.
CPC ..... *F02M 53/043* (2013.01); *F02F 1/242* (2013.01); *F02F 1/26* (2013.01); *F02F 1/36* (2013.01);
(Continued)

(58) Field of Classification Search
CPC .. F02M 2700/077; F02M 53/04; F02M 61/14; F02M 53/06; F02M 61/166;
(Continued)

(56) References Cited

U.S. PATENT DOCUMENTS 2,175,450 A 10/1939 Thege
5,361,990 A * 11/1994 Pimentel ..... B05B 1/24 219/205
(Continued)

FOREIGN PATENT DOCUMENTS

DE 10 2005 011134 9/2006
DE 10 2009 027710 1/2011
(Continued)

*Primary Examiner* — Long T Tran
(74) *Attorney, Agent, or Firm* — Gerard Messina

(57) ABSTRACT

A holding fixture for an injection device for the injection of a medium into a combustion chamber of an internal combustion engine is provided, the injection device including an injector provided with at least one spray-discharge orifice, from which the medium is spray-discharged; the holding fixture has a first region disposed near the spray-discharge orifice of the injector, and a second region which faces away from the spray-discharge orifice of the injector, the holding fixture having at least one tubular heat conduction device, which extends at least between the first region and the second region.

9 Claims, 1 Drawing Sheet

(51) Int. Cl.
*F02F 1/26* (2006.01)
*F02F 1/24* (2006.01)
*F02F 1/36* (2006.01)

(52) U.S. Cl.
CPC ..... *F02M 61/14* (2013.01); *F02M 2200/06* (2013.01); *F02M 2200/85* (2013.01)

(58) Field of Classification Search
CPC ..... F02M 51/005; F02M 53/043; F02M 2200/858; F02M 31/005; F02M 31/087
USPC ..... 123/294–305, 445
See application file for complete search history.

(56) References Cited

U.S. PATENT DOCUMENTS

| | | | | |
|---|---|---|---|---|
| 6,561,168 | B2 * | 5/2003 | Hokao | F02M 51/0682 123/41.31 |
| 7,331,535 | B2 * | 2/2008 | Lambert | F02M 61/16 239/132 |
| 2004/0026532 | A1 * | 2/2004 | Lambert | F02M 61/16 239/132 |
| 2006/0228440 | A1 * | 10/2006 | Ernich | B29C 45/2737 425/549 |
| 2008/0295806 | A1 * | 12/2008 | Chang | F02M 47/027 123/470 |

FOREIGN PATENT DOCUMENTS

| | | | |
|---|---|---|---|
| DE | 10 2010 033710 | | 2/2012 |
| JP | 56101417 | A | 8/1981 |
| JP | 58189365 | A | 11/1983 |
| JP | H06-19550 | A | 1/1994 |
| JP | 5962260 | B2 | 8/2016 |

* cited by examiner

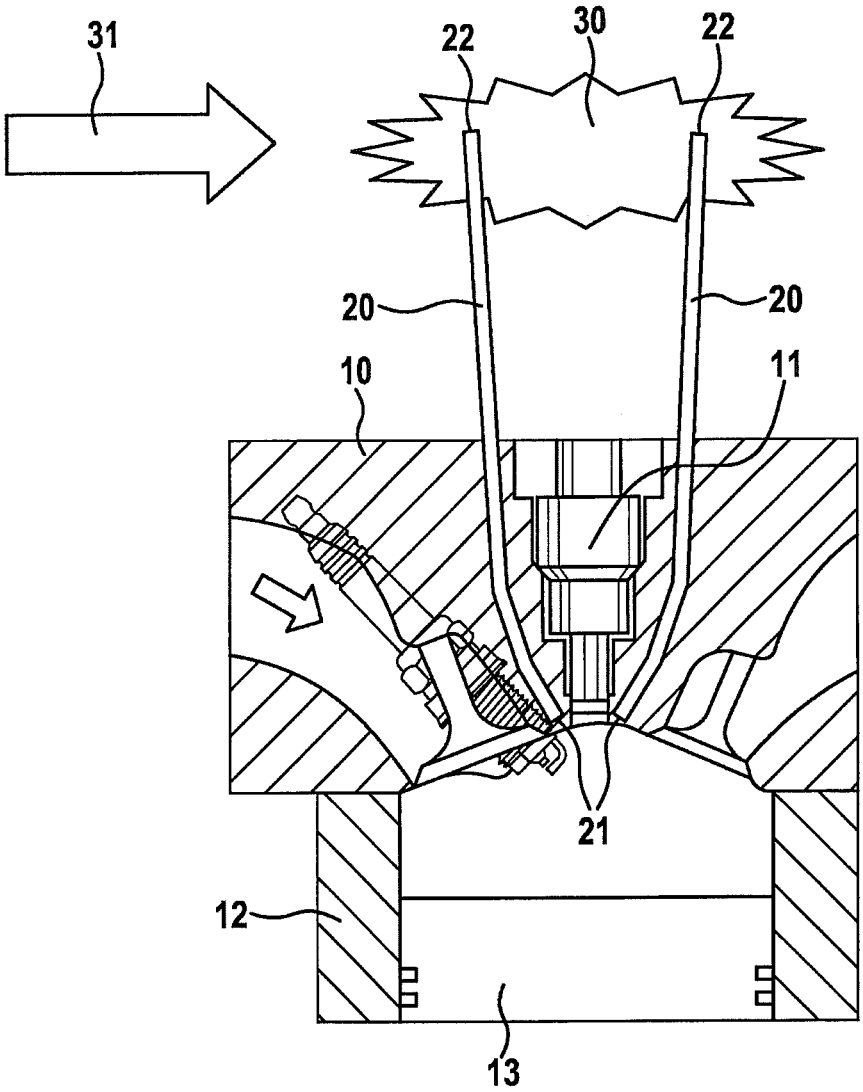
31
22
30
22
20
20
10
11
21
12
13

HOLDING FIXTURE FOR AN INJECTION DEVICE FOR INJECTING A MEDIUM INTO A COMBUSTION CHAMBER OF AN INTERNAL COMBUSTION ENGINE

FIELD OF THE INVENTION

The present invention is based on a holding fixture for an injection device for injecting a medium into a combustion chamber of an internal combustion engine.

BACKGROUND INFORMATION

Injection devices for injecting a medium into a combustion chamber of an internal combustion engine are generally believed to be understood. For example, there are believed to be high-pressure injection valves which, for instance, are configured as conventional solenoid switching valves having a coil and components of a magnetic armature.

Directly injecting valves in Otto engines and diesel engines are exposed to high temperatures because of the direct contact with the combustion chamber. These high temperatures can have a negative effect on the service life of the high-pressure injection valve. In addition, the increased temperatures may cause deposits to form in and on the high-pressure injection valve, which may have a detrimental effect on the performance of the high-pressure injection valve and ultimately, the internal combustion engine.

In internal combustion engines known heretofore, an attempt has been made, for instance by the configuration of cooling devices such as in the form of water ducts, to produce the conditions in or on the cylinder head of the internal combustion engine, especially in the vicinity of the high-pressure injection valve, such that no or only a negligible worsening of the performance occurs while the internal combustion engine is in operation. However, it has not previously been possible to find an optimal solution for all types of internal combustion engines, especially when the space conditions or the constructional details do not permit it. Especially high-pressure injection valves in air-cooled engines are exposed to higher stresses, since in this case the temperatures of the cylinder head (so-called head temperatures) could be considerably higher than in water-cooled engines.

SUMMARY OF THE INVENTION

In contrast to the related art, the holding fixture according to the invention for an injection device for injecting a medium into a combustion chamber of an internal combustion engine has the advantage that the stresses at the high-pressure injection valve are reduced considerably. This markedly slows or stops the deposit-forming processes. In addition, the general thermal stress is reduced, which benefits the service life of the high-pressure injection valve. This is true especially for air-cooled engines and engines for which the installation conditions are less than optimal.

Sufficient cooling by cooling water also requires that the cooling channels are able to be constructed and placed at the required locations. When space is tight, which applies especially to small engines having a high specific output, this is at least partially impossible, so that optimal cooling cannot be guaranteed in all cases. Utilizing the approach according to the present invention, it is therefore possible to realize local cooling at the critical locations in an advantageous manner, under precisely such conditions, using an uncomplicated approach, even when space is tight, i.e., especially at locations in the vicinity of the high-pressure valve or in the vicinity of the injector, or at locations around the high-pressure valve or around the injector. The present invention requires no intervention in the cooling water channels. Simplifications also result with regard to the wall thicknesses to be taken into account. In the present invention it is furthermore advantageous that the cooling measure according to the invention is also able to be introduced retroactively in an already existing cast component. The cooling measure according to the present invention is usable in particular for engines that dispense with water cooling on account of the cost factor. Examples of such situations are motor cycle engines, which—also because of the uncontrollable cylinder head temperatures—are presently not configured as direct-injection engines.

According to the present invention, it is therefore provided that the holding fixture includes a tubular heat conduction device in a first region that is situated in close proximity to the spray-discharge orifice of the injector or in close proximity to the tip of the injector, such that the heat conduction device is able to shunt heat from the first region to a second region, which is disposed or positioned so as to face away from the spray-discharge orifice of the injector or the injector tip. The present invention provides in particular that the first region of the holding fixture is in direct contact with the combustion chamber or abuts it, or that the first region of the holding fixture is actually separated from the combustion chamber, but is in thermally conductive contact with the combustion chamber, and that the second region of the holding fixture is disposed at a distance from the combustion chamber, starting from the first region.

Advantageous embodiments and further refinements of the present invention are mentioned in the dependent claims and the specification with reference to the drawing.

According to one specific embodiment, the at least one tubular heat conduction device has a housing which holds an encapsulated volume, a working medium being disposed in at least a portion of the volume. In an advantageous manner, the present invention thereby makes it possible to use so-called heat pipes as thermal conductors in a direction that typically runs longitudinally; the pipes have a tubular configuration, in particular, and a first end is thermally in contact with a heat source, and a second end of the heat conduction device is thermally linked to a heat sink. A working medium is present in the heat pipe or in the heat conduction device, which evaporates in the region of the heat conduction surface of the heat source; it is then transported to the region of the heat sink, where it condenses again and releases heat to the heat sink in the process. The heat conduction device according to the present invention may also be a so-called thermo-siphon instead of a heat pipe, the fluid working medium being transported back to the heat conduction surface of the heat source following the condensation due to gravitational forces.

In the present invention the holding fixture may be configured as a sleeve, the injector being configured to be connected to the holding fixture so as to establish a releasable connection; the holding fixture is configured to completely enclose the injector in a plane perpendicular to a longitudinal extension direction of the injector. This makes it possible to realize an especially satisfactory cooling effect of the injector or the injection device in the holding fixture according to the present invention, so that excellent cooling of the injection device is possible even when the space in the head region of the internal combustion engine is tight. According to the present invention, especially additionally, the holding fixture may be configured for press-fitting in a cylinder head. The holding fixture, which is configured in the form of a sleeve, in particular has a plurality of heat conduction devices around the injector or, in particular, in the region of the injector tip around the injector (i.e., in a plane perpendicular to the longitudinal axis of the injector, surrounding the region of the injector tip).

Instead of realizing the holding fixture as a sleeve, the present invention also provides the alternative of developing the holding fixture as a cylinder head, while the injector is configured to be connected to the holding fixture in order to establish a releasable connection. In this way the present invention advantageously makes it possible to introduce the heat conduction device directly into the cylinder head of the internal combustion engine, so that a production step of connecting the holding fixture to the cylinder heat may be dispensed with.

Exemplary embodiments of the present invention are illustrated in the drawing and explained in greater detail in the following description.

In the FIGURE(s), identical parts have always been provided with the same reference symbols and are therefore usually labeled or mentioned only once.

BRIEF DESCRIPTION OF THE DRAWING

FIG. 1 shows a schematic sectional view of a cylinder head region of an internal combustion engine.

DETAILED DESCRIPTION

FIG. 1 shows a cylinder head region of an internal combustion engine in a part-sectional view. The combustion engine or the internal combustion engine typically has a plurality of combustion cylinders, which are covered by a cylinder head 10 on the front side. Guided in axially displaceable manner in each combustion cylinder is a reciprocating piston 13, which is connected to a crankshaft in articulated manner by a connecting rod (not shown). Each reciprocating piston 13, together with cylinder head 10, delimits a combustion chamber. FIG. 1 shows a section through cylinder heat 10 and a combustion cylinder 12; in the illustrated exemplary embodiment of the internal combustion engine, two controlled valves (intake valve and discharge valve) are provided for each combustion cylinder for the gas exchange in the combustion chamber, as well as a fuel injector 11 (injection valve 11 or, in particular, a high-pressure injection valve 11) or an injector 11 for the direct injection of fuel into the combustion chamber. In the four-valve technology widely used these days, two intake valves and two discharge valves and one injector 11 or two injectors 11 are provided per combustion cylinder. On the combustion-chamber side, each intake valve seals an intake duct extending in cylinder head 10, and each discharge valve seals a discharge duct extending in cylinder head 10.

Fuel injector 11 or injector 11 for the direct injection of fuel into the combustion chamber, which is provided for each combustion cylinder, is typically installed in a cylinder head bore and connected to a fuel supply line (not shown). On its input side facing away from the intake valve, the intake duct is connected to an induction manifold (not shown), via which air is supplied to the intake duct. When the intake valve is open to a greater or lesser extent, combustion air streams into the combustion chamber in a dosed manner, and fuel injector 11 or injector 11 sprays fuel into the incoming or already present air stream.

As can be gathered from FIG. 1, a front portion of injector 11 (or the injector tip provided with the spray discharge orifice) is projecting into the combustion chamber in the present invention, and in the front area of injector 11, there is a surface region that is in direct contact with the combustion chamber of the internal combustion engine.

In this front portion of injector 11, via which injector 11 is in direct contact with the combustion chamber, injector 11 and, through heat conduction of the material of injector 11, the interior of the injector and thus the injected medium or the fuel as well, is exposed to high thermal stressing or a high thermal load, especially while the internal combustion engine is running. This has the disadvantage that deposits may develop when no special cooling measures are taken. If space is tight, conventional cooling measures in the form of water cooling are difficult to realize because certain wall thicknesses or specifications for the minimum diameter of cooling ducts must be observed. In the present invention, heat conduction devices 20 are now provided in the region that is proximate to the spray-discharge orifice of the injector; they are configured in tubular form, in particular, and have a first end 21 and a second end 22. Via first end 21, i.e., the first region in the vicinity of the spray-discharge orifice of the injector, heat conduction device(s) 20 is linked to the heat source, that is, the heat in the combustion region of the combustion chamber of the cylinder, while second end 22 of heat conduction device(s) 20 is thermally connected to a heat sink 30. Evaporation of a working arrangement takes place at first end 21 of heat conduction device 20 or the plurality of heat conduction devices 20, which working arrangement, encapsulated by heat conduction device 20, especially in hermetically sealed manner, is provided within the housing of heat conduction device 20. Condensation of the working arrangement within the housing of heat conduction device 20 or the plurality of heat conduction devices 20 is provided at second end 22 of heat conduction device(s) 20 because of the effect of heat sink 30, especially in the form of a cooling element or similar device provided there. According to the present invention, this makes it possible to markedly reduce the thermal stressing at the high-pressure injection valve or injector 11, so that deposition processes are considerably slowed or stopped. The general temperature stress can be reduced in addition, which has a beneficial effect on the service life of injector 11.

According to present invention, heat conduction device 20 or the plurality of heat conduction devices 20 is/are disposed within the housing of the cylinder head or within the cylinder head, which is realized as a cast component, in particular, especially a cast made of aluminum. In this case the holding fixture of the present invention for an injection device for injecting a medium into a combustion chamber of an internal combustion engine is the cylinder head or the housing of the cylinder head, especially in the form of a cast component. According to one alternative specific embodiment of the present invention, the holding fixture may also be configured as a sleeve, which is provided with heat conduction device 20 or the plurality of heat conduction devices 20. Such a sleeve, for example, is inserted, especially press-fit, into the cylinder head housing or the cylinder head when the engine or the internal combustion engine is assembled, and thereby is connected to the cylinder head in a permanent and irreversible manner. Such a sleeve has a conventional receiving device, especially in the form of a bore provided with a thread to accommodate an injector 11; heat conduction device 20 or the plurality of heat conduction devices 20 is/are disposed within the sleeve, that is to say, within holding fixture 10, around the bore of the injector. To install injector 11, it is then possible to screw the injector into such a bore or receptacle of a sleeve press-fit in the cylinder head in the conventional manner, and then also to remove it again, for instance in order to exchange the injector.

According to the present invention, heat conduction device 20 or the plurality of heat conduction devices 20 is/are adjusted in such a way that a working temperature of approximately 200° C. is realized; this means that an especially satisfactory heat conduction takes place between first end 21 of heat conduction device 20 and second end 22 at this temperature.

What is claimed is:

1. A holding fixture for an injection device having an injector for injecting a fuel into a combustion chamber of an internal combustion engine, comprising:

a first region disposed near at least one spray-discharge orifice of an injector;

a second region facing away from the spray-discharge orifice of the injector;

at least one tubular heat conduction device extending at least between the first region and the second region;

wherein the injection device includes the injector which has the at least one spray-discharge orifice, from which the fuel is spray-discharged, wherein the at least one tubular heat conduction device is a heat pipe, and wherein a working medium evaporates in the first region and condenses in the second region.

2. The holding fixture of claim 1, wherein the first region of the holding fixture is in direct contact with the combustion chamber or abuts it.

3. The holding fixture of claim 1, wherein the first region of the holding fixture is separated from the combustion chamber, but is in thermally conductive contact with the combustion chamber.

4. The holding fixture of claim 1, wherein, starting from the first region, the second region is disposed at a distance from the combustion chamber.

5. The holding fixture of claim 1, wherein the holding fixture is configured as a sleeve, the injector being connectable to the holding fixture to establish a releasable connection, and wherein the holding fixture is configured to completely enclose the injector in a plane perpendicular to a longitudinal extension of the injector.

6. The holding fixture of claim 5, wherein the holding fixture is configured for press-fitting in a cylinder head.

7. The holding fixture of claim 1, wherein the holding fixture includes a cylinder head, and wherein the injector is connected to the holding fixture to establish a releasable connection.

8. The holding fixture of claim 1, wherein the at least one tubular heat conduction device is a thermo-siphon, wherein the working medium evaporates in the first region and condenses in the second region, and wherein the working medium is transported from the second region to the first region due to gravitational forces.

9. The holding fixture of claim 1, wherein the at least one tubular heat conduction device has a housing holding an hermetically sealed volume, and the working medium is disposed in at least a portion of the hermetically sealed volume.

* * * * *